United States Patent [19]

McIntire

[11] Patent Number: 5,046,856

[45] Date of Patent: Sep. 10, 1991

[54] APPARATUS AND METHOD FOR MIXING FLUIDS

[75] Inventor: William R. McIntire, Tulsa, Okla.

[73] Assignee: Dowell Schlumberger Incorporated, Tulsa, Okla.

[21] Appl. No.: 406,212

[22] Filed: Sep. 12, 1989

[51] Int. Cl.[5] ..... B01F 7/16

[52] U.S. Cl. ..... 366/291; 366/137; 366/297

[58] Field of Search ..... 366/279, 297, 298, 299, 366/300, 261, 263, 265, 264, 270, 241, 137, 190, 291; 166/308, 305.1

[56] References Cited

U.S. PATENT DOCUMENTS

| | | | |
|---|---|---|---|
| 2,243,309 | 5/1941 | Daman | 366/265 |
| 2,573,521 | 10/1951 | Wasley | 366/270 |
| 3,154,601 | 10/1964 | Kalinske | 366/297 |
| 4,828,034 | 5/1989 | Constien et al. . | |

*Primary Examiner*—Robert W. Jenkins

*Attorney, Agent, or Firm*—Stephen A. Littlefield

[57] ABSTRACT

Plug flow through a series of tanks in fluid communication is effected by the addition of radial flow impeller means to at least one of the tanks. Plug flow through the tanks allows for sufficient residence time in the series of tanks to effect complete hydration of a hydratable gel for using in well treatment operations such as fracturing, acidizing and gravel packing.

12 Claims, 4 Drawing Sheets

APPARATUS AND METHOD FOR MIXING FLUIDS

This invention relates to the art of fluid mixing for well treatment operations and, more particularly, to a mixing apparatus and method which effects the substantially complete hydration of a hydratable gel which when added to an aqueous base solution forms a desirable, viscous fluid which may be used to subterranean well treatment operations such as fracturing, acidizing, gravel packing and the like.

BACKGROUND OF THE INVENTION

In subterranean well treatment operations, high viscosity fluids are often formulated using dry additives which are mixed with water or other aqueous fluids at the job site. Such commercial mixing procedures are known to involve inherent problems, particularly on remote sites or when large volumes of fluid are required. For example, special equipment for mixing dry additives in water is required and problems such as chemical dusting, uneven mixing, lumping of gels while mixing and extended preparation and mixing time are involved. The mixing and physical handling of large quantities of dry chemicals require a great deal of manpower and, when continuous mixing is required, the accurate and efficient handling of dry chemicals is extremely difficult. Furthermore, with respect to batch mixing applications, the job delays can result in the deterioration of pre-mix gels and the potential loss thereof as well as chemical losses due to tank bottoms and problems associated with the cost of pre-treatment tank clean-up.

More recently, gelable materials have been supplied in a non-aqueous slurry concentrate which is useful in continuous processes supplying a viscous, gelled aqueous fluid for subterranean well treatment operations. Such a slurry concentrate typically comprises a polymer slurry wherein a hydratable polymer is dispersed in a hydrophobic solvent in combination with a suspension agent and a surfactant and, possibly, including other additives commonly employed in well treatment applications. The hydratable polymer inherently disperses even in the oil-based fluid. This feature tends to eliminate lumping and premature gelation problems and tends to optimize the initial dispersion of the hydratable gel when added to water. However, the rate of hydration of a polymer is still a critical factor particularly in continuous mix applications wherein the necessary hydration and associated viscosity rise must take place over a relatively short time span corresponding to the residence time of the fluid during the continuous mix procedure.

Hydration is a process by which a hydratable polymer chemically combines with water to create a viscous gel. Once the polymer is dispersed, its ability to absorb water will dictate hydration or hydration rate. Several factors determine how readily the polymer will hydrate or develop viscosity such as the pH of the system, the amount of mechanical shear applied in the initial mixing phase, the concentration of salts in the aqueous fluid and the polymer loading in the system. Hydration rate can be influenced through pH control agents which may be blended with the polymer or added to the aqueous medium. Hydration rate can also be controlled by the level of applied shear, with the solution viscosity increasing faster when subjected to high shear. The rate of viscosity development may be influenced, particularly in low shear applications, by the salts present in the solution. The extent of retardation of hydration is dependent on the concentration and type of salt. Finally, the viscosity level achieved at a particular point in time is a function of polymer concentration.

Unmodified guar will develop viscosity in all electrolyte systems such as those contained in KCl, NaCl, and $CaCl_2$ at high concentrations. Guar gum hydrates most efficiently in the pH range of 7 to 8, yielding viscosities of 32–36 cps at 500 $sec^{-1}$ in 2% KCl. Guar will not hydrate in organic solvents such as methanol.

Hydroxypropyl guar (HPG) hydrates well in many salt systems at 80° F., and also develops excellent viscosity at temperatures of 40° F. Depending on the mechanical shear applied, 80–90% of the viscosity can be achieved within ten minutes. Optimum hydration of HPG can be realized at a pH in the range of 4 to 6. HPG also viscosifies mixtures of methanol and 2% KCl in water used typically in a ratio of 50/50.

Carboxymethyl hydroxypropyl guar (CMHPG) hydrates most electrolyte make-up solutions, however, it is more sensitive to these solutions than guar or HPG. CMHPG hydrates well in both cold and warm water.

In a manner similar to the above natural polymers, synthetic polymers may also be dispersed and hydrated. However, in contrast to these natural polymers, hydration and dispersion will rely more on mechanical mixing of synthetic polymers.

Several attempts have been made over the last thirty years to perfect the process and chemicals for continuous preparation well treatment fluids. A continuous process would allow the fluids to be made in "real time" during the treatment process. This process would have several advantages over the current common method of producing fluids which involve "batch" mixing of water, gelling agent and other additives into individual "frac" tanks before the treatment is begun. The process is expensive because of the time and equipment required and because of wasted and unused fluid resulting from treatment delays, termination of the treatment before pumping all fluids, and fluid left in the bottom of the tanks which cannot be pumped out. The disposal of unused gelled fluids has also become an expensive process because of stricter laws on the disposal of chemical wastes. More recently, it has been proposed to effect the hydration of a gelable fluid for well treatment operations by increasing the residence time of the gelable fluid in a flow-through operation by providing a series of vertical flow tanks. The hydratable gel material is mixed with water at the beginning of the series of tanks and, in theory, the mixture passes through the series of vertical flow tanks in a "plug flow" which gives the gelable material sufficient time to hydrate in the aqueous mixture. Such a system is described in U.S. Pat. No. 4,828,034 in order to achieve substantially complete hydration of the hydratable gel. However, such system requires the application of high shear such as by pumping the mixture through a centrifugal pump at some point along the series of vertical flow tanks. As used in this specification, the term vertical flow tanks will be understood to mean a series of underflow and overflow tanks wherein the primary flow through the tank is in the vertical direction, up or down.

As used in this specification, the term "substantially complete hydration" shall be understood to mean hydration of a polymer which achieves a viscosity in the range of at least 80–90% of the final viscosity of a completely hydrated gel.

Further, as used in this specification, the term "plug flow" shall be understood to mean any type of flow conditions or associated equipment that tend to simulate a first-in-first-out, FIFO, behavior thus maximizing the effective residence time per unit volume of tank at any given flow.

SUMMARY OF THE INVENTION

The present invention provides for the rapid and substantially complete hydration of a hydratable gel by achieving near absolute theoretical plug flow through a plurality of tanks in series fluid communication.

In accordance with the invention, an apparatus for effecting substantially complete hydration of an aqueous dispersion of a hydratable gel for a well treatment fluid by providing plug flow with high shear through a plurality of tanks in series fluid communication comprises at least one radial flow impeller means having an axis of rotation positioned parallel to an axial flow path within at least one of the plurality of vertical flow tanks and further including means for rotating the radial flow impeller means.

Further in accordance with the invention, a plurality of radial flow impeller means are provided in a plurality of the tanks which are in series fluid communication.

Still further in accordance with the invention, a method for providing rapid hydration of a hydratable polymer in an aqueous well treatment fluid comprises the steps of:

a. providing an oil-based polymer concentrate slurry comprising a hydratable polymer dispersed in a hydrophobic carrier fluid;

b. injecting an effective amount of the oil-based polymer concentrate slurry into a water stream to achieve the desired ultimate viscosity;

c. pumping the mixture of oil-based polymer concentrate and water produced in step (b) into a series of essentially plug flow tanks in series fluid communication, at least one of the tanks including radial flow impeller means having an axis of rotation positioned parallel to an axial fluid flow path within at least one of the plurality of tanks, and d. removing the substantially completely hydrated well treatment fluid from an outlet of the plurality of tanks in series fluid communication for use in well treatment.

BRIEF DESCRIPTION OF THE DRAWINGS

The invention will now be described in greater detail and with reference to the accompanying drawings forming a part of this specification and in which.

DETAILED DESCRIPTION OF THE PREFERRED EMBODIMENTS AND THE DRAWINGS

The present invention will now be further described in the more limited aspects of a preferred embodiment thereof including various parts and arrangements of parts. It will be understood that the invention is not limited only to the disclosed features of the preferred embodiments but has a broader scope which will be clearly understood by those skilled in the art.

The use of a series of vertical flow tanks for hydration of the hydratable gel is based upon the assumption that the fluid flows through the series of tanks in "plug flow". If the fluid were in turbulent flow, then this assumption would be reasonable since the turbulent eddies moving through the tanks prevent chanelling of fluid and the bypassing of large volumes of fluid in the tanks.

Fully developed laminar flow in vertical flow tanks would also exhibit nearly plug flow character. However, laminar flow through a series of vertical flow tanks which can be scaled up to trailer-mounted tanks is observed to be dominated by entrance effects. The theoretical parabolic fluid velocity profiles never develop, and large portions of the tanks' volumes are bypassed as the fluid channels through with reduced residence time.

In hydrating fluids for well treatment operations, the required flow rates and fluid viscosities cause the fluid to make the transition from turbulent to laminar flow within the hydration tanks. Fluid which starts in turbulent flow changes to laminar flow as the viscosity builds upon partial hydration of the gel. The laminar flow in the vertical flow tanks is dominated by entrance length effects which result in a poor age distribution of the fluid.

These chanelling effects are grossly aggravated by normal start-up conditions for field use of gels in a series of vertical flow tanks. The tanks are initially filled with completely hydrated viscous fluid. With the admission of low viscosity fluid to the tanks, severe channelling of the thin fluid through the thickened fluid occurs.

Figure 1:
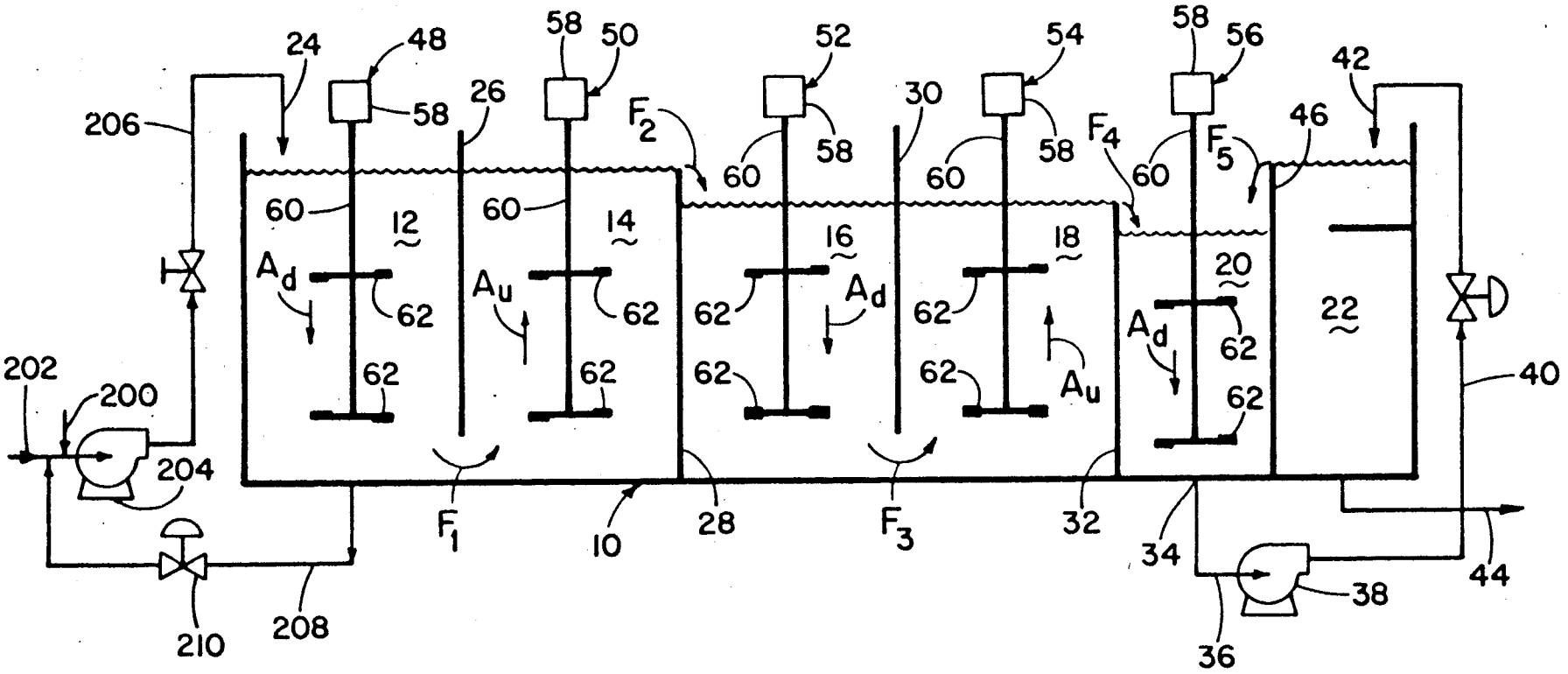
FIG. 1 illustrates a plurality of tanks in series fluid communication in accordance with the present invention.

Referring now to the drawings wherein the showings are for the purpose of illustrating a preferred embodiment of the invention and not for the purpose of limiting same, FIG. 1 illustrates a preferred, plug flow mixing apparatus 10 comprising a series of tanks 12, 14, 16, 18, 20 and 22, representing, in sequence, the series flow path through the mixing apparatus 10. Each of the tanks 12–22 has a vertical axial flow path which is axially downward indicated by arrows $A_d$ in tanks 12, 16 and 20, respectively, and axially upward indicated by arrow $A_u$ in tanks 14 and 18. Thus, fluid entering tank 12 through inlet 24 flows axially downwardly through tank 12 and under first separator wall 26 into tank 14 in the direction of arrow $F_1$. In tank 14, the upward axial flow causes the fluid in the tank to pass over separator wier 28 in the direction of arrow $F_2$ into tank 16. In a manner similar to tanks 12 and 14, the fluid flows axially downwardly in tank 16 and under a second separator wall 30 in the direction of arrow $F_3$ into tank 18 where the flow is axially upwardly and over a second separator wier 32 in the direction of arrow $F_4$ into tank 20.

In accordance with a preferred embodiment of the invention, tank 20 includes a bottom outlet 34 which is connected through piping 36 to a centrifugal pump 38 which moves the fluid from tank 20 through a feed line 40 to an inlet 42 of tank 22. Tank 22 is essentially a holding tank for completely hydrated fluid which may be withdrawn from the bottom of the tank through discharge outlet 44. Excess fluid supplied to the tank 22 is returned over overflow wier 46 in the direction of arrow $F_5$ back into tank 20 for recirculation.

In accordance with the invention at least one of tanks 12, 14, 16, 18 and 20 includes a radial flow impeller means 48, 50, 52, 54 and 56, respectively. Each radial flow impeller means 48–56, includes a drive means 58, a drive shaft 60 having an axis of rotation which is parallel to the axial flow path $A_d$ or $A_u$ in its respective tank and at least one, and preferably two, radial flow impellers 62 located along each shaft 60. The drive means 58 for each of the radial flow impeller means 48–56 may be independently operated or powered by a common power source. In the preferred embodiment of the invention, all impeller means 48–56 are powered by hydraulic pressure through a hydraulic circuit attached to each drive means 58. Although hydraulic drive is preferred, it will be understood by those skilled in the art that other types of drive means may be provided.

Figure 2:
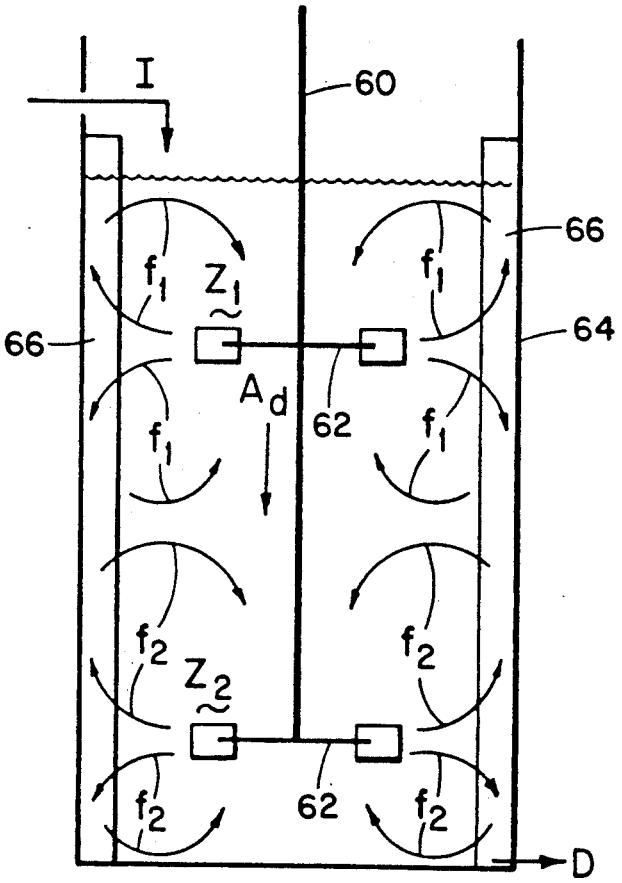
FIG. 2 is a schematic illustration of a tank including radial flow impellers in accordance with the present invention.

The primary purpose of the impeller means 48–56 is to interrupt the axial flow $A_u$ or $A_d$ in the tank in which it is mounted. FIG. 2 illustrates the action of radial flow impellers within a tank having downward axial flow $A_d$. In accordance with the invention, a tank 64 has a top inlet I and a bottom discharge D in order to effect generally axially downward flow $A_d$ through the tank 64. Positioned generally centrally within the tank is an impeller drive shaft 60 having an axis of rotation parallel to the axial flow path $A_d$ through the tank 64. The drive shaft 60 spins a pair of radial flow impellers 62 which are well known in the art which act to set up two separate mixing zones $Z_1$ and $Z_2$ in the upper and lower portions of the tank 64, respectively. The radial outwardly directed flow and return in the upper zone $Z_1$ is indicated by the arrows $f_1$. Similarly, the radial outward and return flow in the bottom zone $Z_2$ is indicated by the arrows $f_2$. It can be clearly seen by those skilled in the art that the radial mixing pattern in the top and bottom zones $Z_1$ and $Z_2$, respectively, act to interrupt the axial flow $A_d$ of the tank 64 and also effect more rapid hydration of the fluids therewithin through the application of relatively high shear by the action of the radial flow impellers 62. It has been found that in an unstirred tank which does not include the radial flow impellers of the present invention, channelling occurs within a tank wherein certain portions of the tank fluid pass from the inlet to the outlet in a substantially direct path while other portions of the tank are left substantially unmixed and undisturbed. This reduces the effective residence time for the hydrating fluid.

In contrast, a tank having radial impeller means 62 such as illustrated in FIG. 2 provides substantially uniform age distributions for the fluids passing through the tank at any given level within the tank 64. In order to insure even greater uniformity of the fluids, baffle means 66 may be provided within the tank in accordance with a preferred embodiment of the invention. The baffle means 66 may be of any form but, preferably, comprise simple planar partial walls oriented along the flow axis $A_d$ of the tank and are co-planar with the drive shaft 60 which is similarly axially oriented within the tank.

Figure 3:
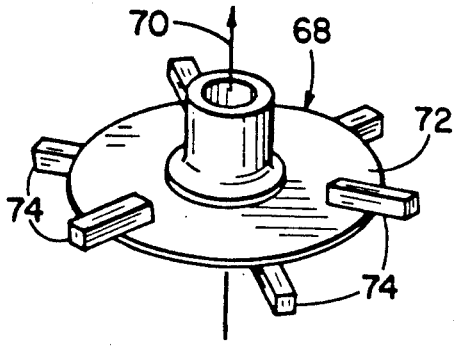
FIG. 3 shows one type of radial flow impeller which may be utilized in accordance with the preferred embodiment of this invention.
Figure 4:
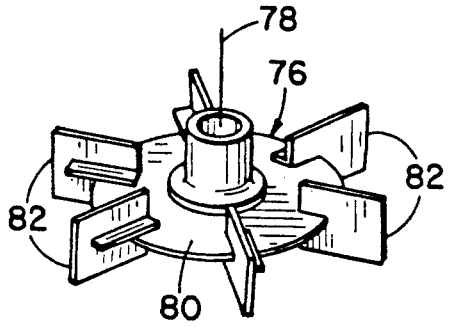
FIG. 4 illustrates another type of radial flow impeller which may be used in accordance with the present invention.

FIGS. 3 and 4 illustrate two types of common radial flow impellers which may be used in accordance with the present invention. FIG. 3 shows a typical bar turbine 68 having a rotational axis 70 passing through the center of a circular disc 72. A plurality of radially oriented bars 74 are attached to the disc 72 by either welding or bolting. The bars are evenly distributed both circumferentially around the disc 72 and equally divided between the upper and lower faces of the disc 72.

FIG. 4 illustrates a flat blade turbine 76 having a rotational axis 78 passing perpendicularly through a circular disc 80. A plurality of planar, radially and axially oriented flat blades 82 are arrayed evenly around the circumference of the disc 80.

The choice of use of a bar turbine or a flat blade turbine or other radial flow impeller with the present invention may be made by those skilled in the art depending on various considerations such as the amount of shear stress desired and the amount of power available to rotate the radial impeller means. While the flat blade turbine 76 provides for extremely effective mixing, it also requires large amounts of power in order to drive it a high rotational speeds. To the contrary, the bar turbine 68 requires considerably less power to provide the same high shear rates but, in exchange, offers somewhat lower mixing efficiency than the flat blade turbine 76. In Applicant's preferred embodiment of the invention, the entire mixing apparatus is mounted as a mobile unit on a trailer and thus has limited power availability. For this reason, the bar turbines 68 are preferably used for their lower power requirements for high shear rates while providing adequate mixing efficiency.

Figure 5:
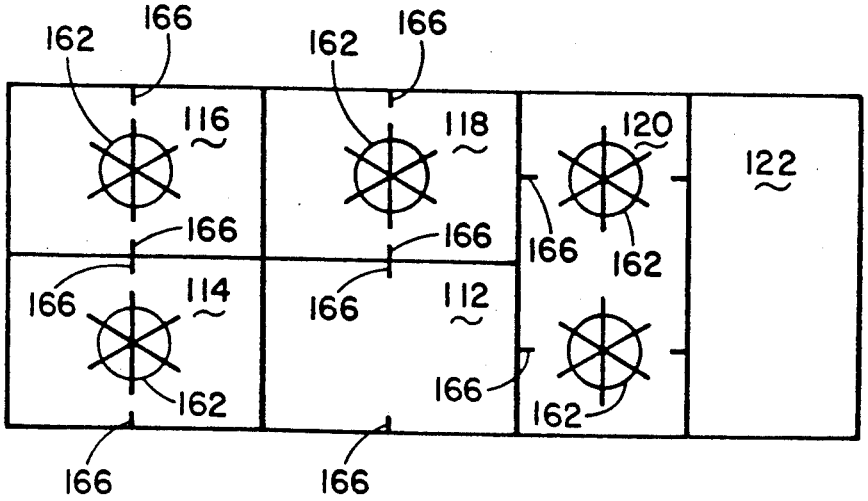
FIG. 5 illustrates a preferred, compact arrangement of the plurality of tanks shown in FIG. 4 as they might be positioned in plain view on a transportable vehicle.

FIG. 5 illustrates the preferred arrangement of tanks 12–22 for mounting on a mobile unit. In accordance with the preferred arrangement, the first tank, tank 12, is unstirred. Tanks 114, 116 and 118 each contains single radial flow impeller drive means each having a drive shaft and a pair of radial flow impellers 162. Tank 120 contains a pair of spaced impeller means, each having a drive shaft and a pair of vertically spaced radial flow impellers 162. Holding tank 122 is unstirred. Further in accordance with the invention, at least each of tank 114, 116, 118 and 120 include vertically oriented baffle means 166 which are parallel to the axial flow path within each tank and co-planar with the axis of rotation of the drive shafts for the radial flow impeller means 162. It will be understood, however, that such baffle means 166 are merely preferred and are not required to effect the desirable characteristics of the present invention. Similarly, tank 112 also optionally includes baffle means 166.

Figure 6:
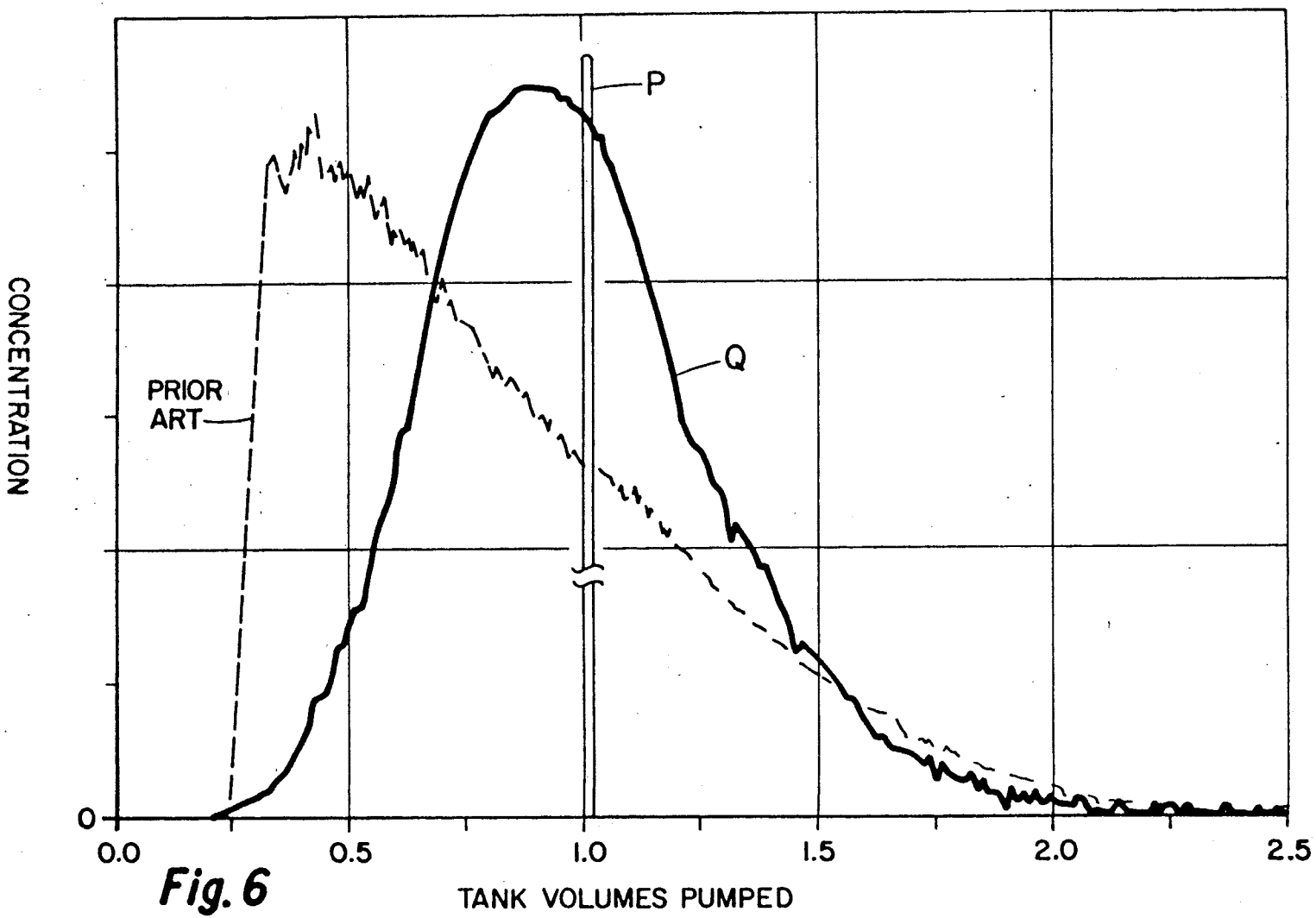
FIG. 6 is a graph illustrating the improved plug flow characteristics of the apparatus of the present invention in comparison with a vertical flow tank system.

FIG. 6 illustrates the near plug flow characteristics of the present invention as compared with true plug flow and with the flow characteristics of vertical flow tanks. In order to test each of the systems, a pulse of fluid containing a high concentration of salt is admitted to each system at time 0 as represented on the graph of FIG. 6. Thus, true plug flow through the system is represented by curve P which appears as vertical spike along the horizontal axis at the point at which one tank (or plurality of tanks) volume has been pumped through the system. The dashed line labelled PRIOR ART shows substantial channelling of portions of the salt pulse through the system with a large portion of the salt pulse appearing prior to the passage of half of a tank volume with considerable trailing out of the remaining salt material over time. The substantially improved performance of the flow apparatus of the present invention is illustrated by the solid line curve labelled Q. As can be clearly seen from line Q, there is considerably less channelling through the system with the largest amount of the salt pulse passing through the system at near plug flow as compared to the prior art flow conditions.

Figure 7:
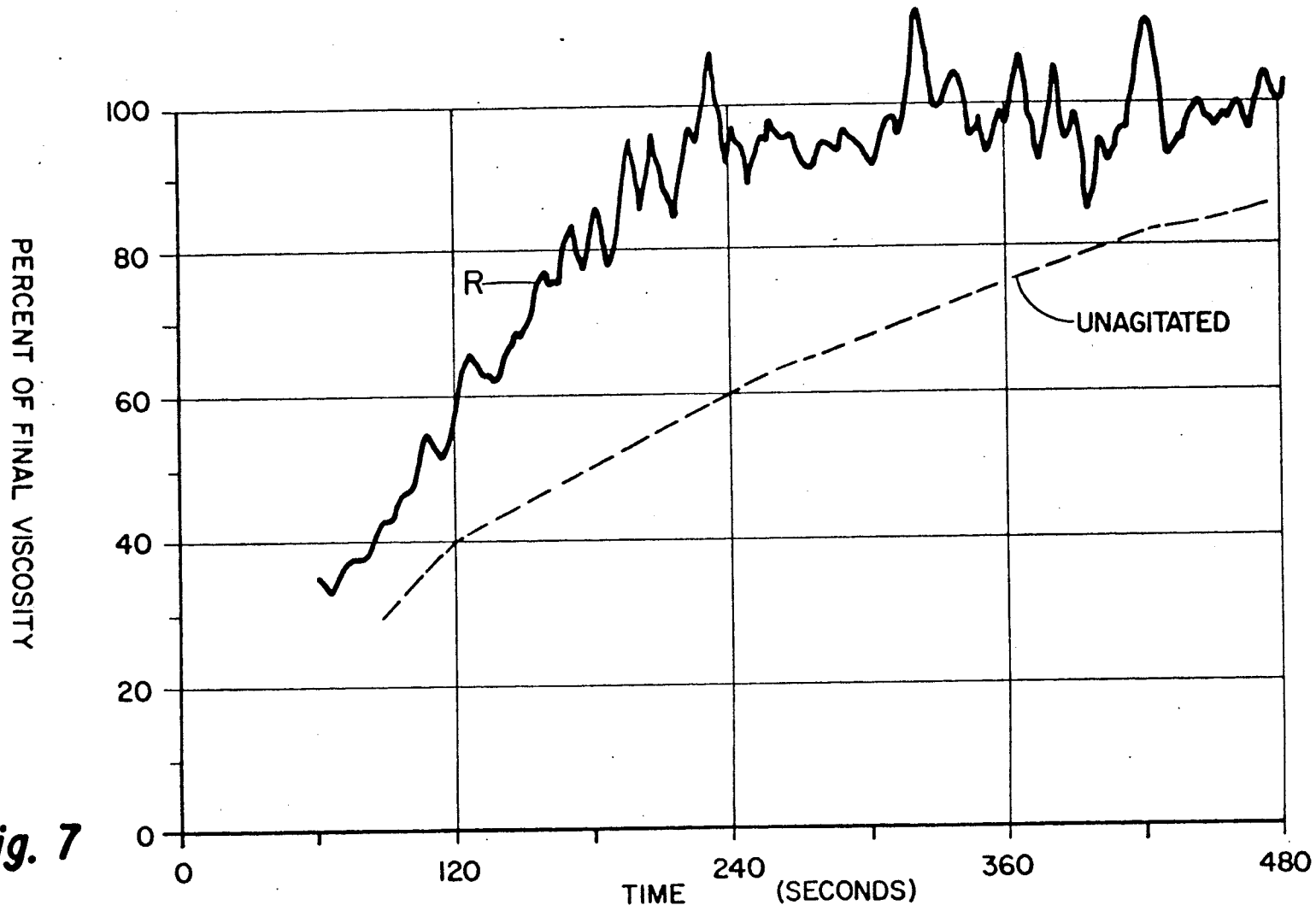
FIG. 7 is a graph illustrating the improved hydration kinetics in the apparatus of the present invention in comparison with hydration kinetics in an unagitated system.

FIG. 7 illustrates the hydration kinetics of a hydroxypropyl guar measured in the preferred embodiment of the present invention as compared with the hydration kinetics of the same hydroxypropyl guar measured in an unagitated condition following a high-shear initial mixing period for dispersion of the gel in the aqueous base fluid. To measure the hydration kinetics in the preferred embodiment of the present invention without the effects of age distributions, the non-aqueous slurry concentrate of the gel is injected into a stream of water which is pumped by a centrifugal pump directly into tank 20 without passing through the other tanks. The mixture of water and non-aqueous slurry concentrate is held in tank 20 and the radial flow impellers 162 are driven to agitate the fluid. The viscosity of the hydrating fluid is measured with a viscometer mounted in tank 20. To measure the hydration kinetics in an unagitated condition, a sample of the non-aqueous slurry concentrate is mixed with water in a Waring blender for 15 seconds to disperse the concentrate into the water. Then the mixed fluid is transferred to a Fann viscometer in which the fluid's viscosity is measured at one-minute intervals. The Fann viscometer is turned off between measurements to prevent agitation of the fluid by the measurement apparatus. In FIG. 7, the dashed line labelled UNAGITATED shows the viscosity development of the fluid in the Fann viscometer. The substantially improved hydration kinetics due to the agitation in the present invention is illustrated by the solid line labelled R. As can be clearly seen from line R, the residence time required for complete hydration is drastically reduced by the high-shear mixing in the present invention, compared to the unagitated conditions present in the vertical flow tanks.

In accordance with the method of the invention, rapid hyration of a hydratable polymer is accomplished by providing an oil-based polymer concentrate slurry comprising a hydratable polymer dispersed in a hydrophobic carrier fluid at a point 200 (FIG. 1) in an aqueous fluid flow stream 202 flowing into a centrifugal pump 204. The discharge of the centrifugal pump 204 passes through feedline 206 to the fluid inlet 24 in the preferred mixing apparatus 10. An effective amount of the oil-based polymer concentrate slurry is injected into water stream 202 at the point 200 in order to achieve the desired ultimate viscosity of the fluid at the outlet 44 of the mixing apparatus. A recirculation line 208 with a recirculation valve 210 may be provided in tank 12 to return a portion of the fluid therewithin to the water inlet line 202. Following discharge of the substantially complete hydrated fluid through the discharge 44, the fluid may be used in and mixed with other well treatment materials such as fracture proppant, gravel pack material and the like for the desired well treatment operations.

While the invention has been described in the more limited aspects of a preferred embodiment thereof, other embodiments have been suggested and still others will occur to those skilled in the art upon a reading and understanding of the foregoing specification. It is intended that all such embodiments be included within the scope of this invention as limited only by the appended claims.

Having thus described my invention, I claim:

1. An apparatus for providing rapid hydration of a hydratable polymer in an aqueous well treatment fluid comprising:

(a) means for injecting an effective amount of an oil-based polymer concentrate slurry into water conduit means;

(b) pump means attached to said water conduit means to effect transport of fluids within said water conduit means into a plurality of essentially plug flow tanks in series fluid communication;

(c) at least one radial flow impeller means having an axis of rotation positioned parallel to an axial fluid flow path within at least one of said plurality of tanks;

(d) means for rotating said at least one radial flow impeller means, and (e) means for removing fluid from an outlet of said plurality of tanks.

2. The apparatus as set forth in claim 1 further including a pair of axially spaced radial flow impeller means in said at least one of said plurality of tanks.

3. The apparatus as set forth in claim 1 further including a plurality of radial flow impeller means in a plurality of tanks.

4. The apparatus as set forth in claim 3 wherein each of said plurality of impellers includes a pair of axially spaced radial flow impellers.

5. The apparatus as set forth in claim 1 further including axially oriented baffles which are co-planar with said axis of rotation of said radial flow impeller means.

6. The apparatus as set forth in claim 1 further including at least one high shear centrifugal pump.

7. The apparatus as set forth in claim 1 wherein said radial flow impeller means includes at least one bar turbine.

8. The apparatus as set forth in claim 1 wherein said radial flow impeller means includes at least one flat blade turbine.

9. The apparatus as set forth in claim 3 wherein said plurality of radial flow impeller means include a common power drive system.

10. The apparatus as set forth in claim 9 wherein said common power drive system is a hydraulic drive system.

11. A method for providing rapid hydration of a hydratable polymer in an aqueous well treatment fluid comprising the steps of:

(a) providing an oil-based polymer concentrate slurry comprising a hydratable polymer dispersed in a hydrophobic carrier fluid;

(b) injecting an effective amount of the oil-based polymer concentrate slurry into a water stream to achieve the desired ultimate viscosity;

(c) pumping the mixture of oil-based polymer concentrate and water produced in step (b) into a series of essentially plug flow tanks in series fluid communication, at least one of the tanks including radial flow impeller means having an axis of rotation positioned parallel to an axial fluid flow path within at least one of the plurality of tanks; and (d) removing the substantially completed hydrated well treatment fluid from an outlet of the plurality of tanks in series fluid communication for use in well treatment.

12. The method as set forth in claim 11 further including the step of circulating a portion of the well treatment fluid to the water stream.

* * * * *